United States Patent [19]

McNarry et al.

[11] Patent Number: 4,903,926

[45] Date of Patent: Feb. 27, 1990

[54] DETACHABLE IMMERSIBLE SUPPORT FOR SUPPORTING ARTICLES IN A SWIMMING POOL

[75] Inventors: Daniel G. McNarry; Mark A. Baker, both of Gloucester, Canada

[73] Assignee: Poolside Peripherals Ltd., Gloucester, Canada

[21] Appl. No.: 277,010

[22] Filed: Nov. 28, 1988

[51] Int. Cl.[4] ..... A47C 31/00

[52] U.S. Cl. ..... 248/214; 4/496; 211/86

[58] Field of Search ..... 248/214; 4/496, 578, 4/579; 272/71; 211/86, 113

[56] References Cited

U.S. PATENT DOCUMENTS

| | | | |
|---|---|---|---|
| D. 256,747 | 9/1980 | Stephen . | |
| D. 260,832 | 9/1981 | Verdesca et al. . | |
| D. 270,506 | 9/1983 | Thorne . | |
| 2,244,650 | 6/1941 | Curran et al. . | |
| 2,580,942 | 1/1952 | Murad et al. . | |
| 4,312,536 | 1/1982 | Lloyd | 297/217 |
| 4,346,885 | 8/1982 | Mathou . | |
| 4,570,803 | 2/1986 | Peterson . | |
| 4,724,773 | 2/1988 | Newberry et al. . | |

*Primary Examiner*—Blair M. Johnson
*Attorney, Agent, or Firm*—James Hellwege

[57] ABSTRACT

A detachable immersible support for supporting articles in a swimming pool comprising a mooring bracket, a U-shaped frame member, an article support, and a frame member spacer, wherein the mooring bracket is comprised of two substantially horizontal oppositely disposed ends of a vertical central portion, one end is adapted to be fastened to the coping on the pool or the ground beside the coping, the vertical portion is adapted to be spaced a short distance inside the wall of the pool, the second horizontal end extends outwardly from the vertical member, the U-shaped frame member is comprised of a down leg, a horizontal leg and an up leg, the upper end of the down leg is fastened to the mooring bracket and is adapted to be suspended substantially parallel to and spaced from the pool wall, the horizontal leg of the U-shaped frame member is arranged at substantially 90 degrees relative to the down leg, the up leg of the U-shaped frame member is arranged at substantially 90 degrees relative to the horizontal leg and substantially parallel to the down leg, the top of the up leg contains a support means to receive and support an article, and the frame member spacer is comprised of a member disposed between the lower portion of the down leg of the U-shaped frame member and the pool wall at right angles to the down leg of the U-shaped frame member.

4 Claims, 2 Drawing Sheets

DETACHABLE IMMERSIBLE SUPPORT FOR SUPPORTING ARTICLES IN A SWIMMING POOL

BACKGROUND OF INVENTION

This invention relates to a detachable immersible support for attachment to the coping or ground beside the coping of a pool to support a seat, table, umbrella, or other article either in or above water level in a swimming pool.

One use is to support a seat below water level in the pool so that the bather may relax near the edge of a swimming pool while semi-submerged in the water of said pool.

Prior to this invention the swimming public has had to make do with floating chairs or supports in which the supported article was disposed at the bottom of the support.

The design of the present invention for the support when supporting a seat provides the occupant a full 360 degrees of rotation providing a full field of view which is useful when supervising toddlers in a pool environment. The design also provides means for a foot rest.

BRIEF SUMMARY OF THE INVENTION

This invention is designed to provide a means of support for seats, for tables, umbrellas or basketball nets either immersed in, at or over the surface of the water. It also provides a means for people who do not swim to enjoy the cooling effect of a swimming pool during hot weather. The detachable, immersible support may in many ways revitalize the backyard pool in that people who have had their pools for some time and have become bored with them, may now have a new reason to enjoy some variety of experience through use of the detachable immersible support.

One object of the present invention is to provide a support for a stool that by being submerged allows the occupant to relax while semi-submerged in the water of a suitable swimming pool with a maximum of comfort and safety.

Another object of the present invention is to provide a support for articles in a pool that can be installed or removed with an absolute minimum of effort and be installed and removed at any part of a pool having horizontal coping.

It is a further object of the present invention to provide a support for a variety of articles and which may be assembled or disassembled with maximum ease and one that can be manufactured and broken down for packaging efficiently and economically.

The above mentioned objectives will be further appreciated after a thorough examination of the accompanying drawings.

PREFERRED EMBODIMENTS OF THE INVENTION

Figure 1:
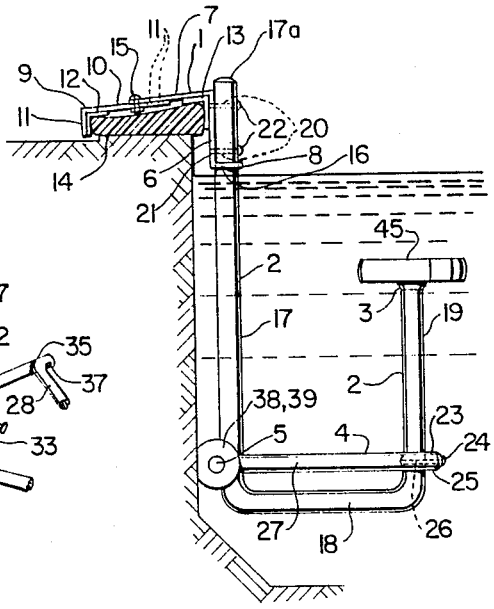
FIG. 1 is a side view of the detachable immersible support and its preferred embodiment.

Referring to FIG. 1, it will be noted that the detachable immersible support is comprised of five main components, a mooring bracket 1, a U-shaped frame member 2, an article support 3, a V-shaped frame stabilization bracket 4, and a frame member spacer 5.

Referring to FIG. 1, the mooring bracket 1 consists of a Z-shaped piece having a vertical member 6 disposed between two substantially horizontal ends 7 and 8 respectively. An L-shaped piece 9 is comprised of one end 10 which fits under the horizontal end 7. Both horizontal end 7 and horizontal end 10 of L-shaped piece 9 have a series of matching holes 11 therein. The inside angle of L-shaped piece 9 and the angle between vertical member 6 and horizontal end 7 are respectively lined with rubber insulation 12, 13. In the embodiment of the invention shown in FIG. 1, L-shaped piece 9 is pressed against the coping 14 of the pool and fasteners 15 are inserted in apertures 11 in the overlapping pieces 7 and 10 and the pieces are secured relative to one another by tightening fasteners 15. This adjustment between overlapping pieces 7 and 10 is designed to allow the mooring bracket 1 and the detachable immersible support to be used with the three popular sizes of horizontal pool coping.

The opposite end of mooring bracket 1 is perpendicular to vertical member 6 and contains an aperture 16 adapted to receive one leg of U-shaped frame member 2.

The U-shaped frame member 2 is comprised of a down leg 17, a horizontal leg 18 and an up leg 19. The top of the down leg includes a cap 17*a*. The upper part of down leg 17 is placed in the aperture 16 in horizontal end 8 which extends in the opposite direction from vertical member 6 than the direction of horizontal member 7. The upper part of down leg 17 contains apertures 20 which correspond with apertures 21 in vertical member 6. Fasteners 22 are inserted through aligned respective apertures 20 and 21 fastening U-shaped member 2 firmly to mooring bracket 1. The upper part of up leg 19 contains article support 3.

The V-shaped frame stabilization bracket 4 may be made by bending a piece of tube about a central point 23. The V-shaped frame stabilization bracket 4 is connected to the lower portion of up leg 19 by fastener 24 which fits through aligned apertures 25 at the central point 23 and aperture 26 in up leg 19. The arms 27 and 28 of V-shaped frame stabilization bracket 4 extend towards the pool wall and are aligned substantially parallel to the horizontal leg 18 of U-shaped frame member 2.

Figure 2:
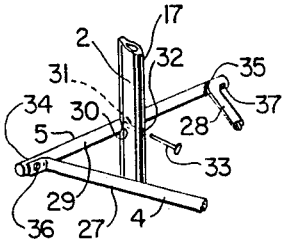
FIG. 2 is a perspective view of the frame member spacer attached to the down leg of the U-shaped frame member.

As seen in FIG. 2 the frame member spacer 5 is comprised of a tube 29 which fits into an indentation 30 in down leg 17 of U-shaped frame member 2. Tube 29 includes a centrally disposed aperture 31 which is aligned with aperture 32 in the down leg 17. A fastener 33 is inserted through apertures 32 and 31 and frame member spacer 5 is firmly attached to down leg 17. The ends of arms 27 and 28 of V-shaped stabilization bracket 4 are fastened near the ends 34 and 35 of frame member spacer 5 by fasteners 36 and 37. Foam pads 38 and 39 are disposed on either side of tube 29 between the center and ends 34 and 35 of the frame member spacer 5.

Figure 3:
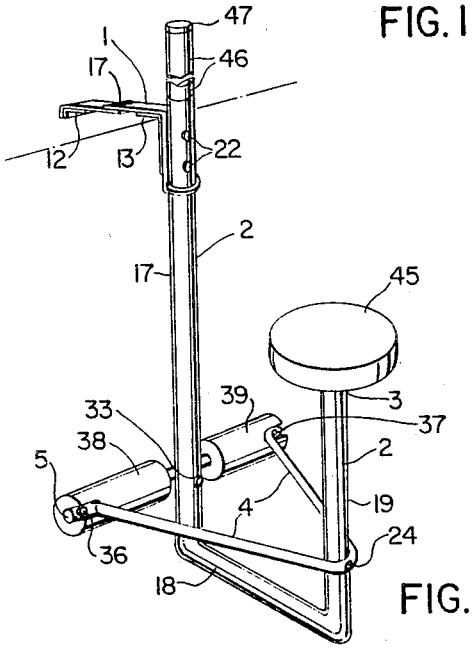
FIG. 3 is a perspective view of one embodiment of the detachable immersible support.

FIG. 3 is a perspective drawing of the detachable immersible support showing a further embodiment in which the cap 17*a* has been removed from the top of down leg 17 and an upright member 46 having slots adapted to fit over fasteners 22 is inserted into the top of down leg 17. The top of upright member 46 includes an attaching device 47 designed to receive and retain an umbrella, hoop, flower support or other device which the pool owner desires to attach to attaching device 47.

Figure 4:
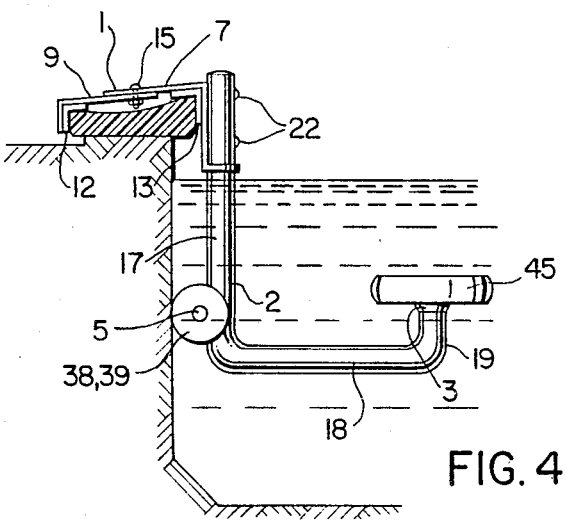
FIG. 4 shows an alternative embodiment of the pool support featuring a shorter seat support without the stabilization bar (4) shown in FIG. 1.

FIG. 4 shows an alternative embodiment of the detachable immersible support in which the down leg 17 and up leg 19 are substantially shorter. Because of the shortness of the down leg 17 and up leg 19 the V-shaped frame stabilization bracket is not utilized in this particular embodiment.

Figure 5:
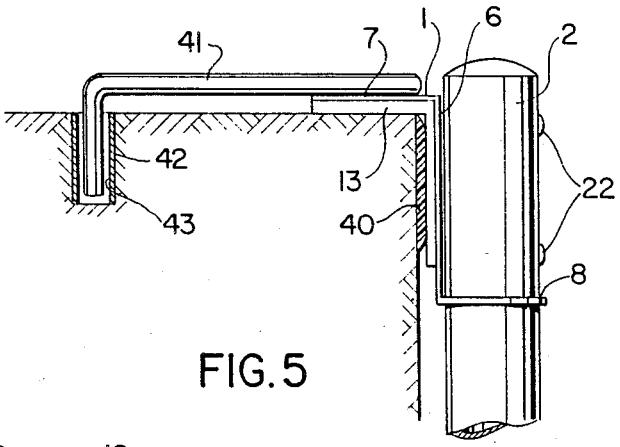
FIG. 5 illustrates an embodiment of the pool support applied to a pool having vertical coping where the fastening means is fastened to the ground. This embodiment is intended for use in swimming pools featuring the newer style vertical coping.

FIG. 5 discloses a different mooring bracket 1 which is used in association with a swimming pool having a vertical coping 40. In this arrangement rubber insulation 12 is placed on the inside of vertical member 6 and horizontal end 7 of the Z-shaped piece forming part of the mooring bracket 1. The rubber insulation protects the vertical coping 40 from vertical member 6 and also serves to space the U-shaped frame member 2 from the pool wall. The top of horizontal end 7 is fastened to an L-shaped tube 41 and the end 42 of L-shaped tube 41 is inserted in a receptacle 43 bored in the concrete or brick surrounding the pool.

Figure 6:
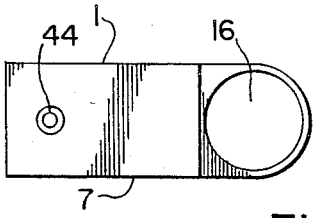
FIG. 6 shows alternative embodiments of the top portion of the mooring bracket.

FIG. 6 discloses a similar mooring bracket 1 to that disclosed in FIG. 5 with a different means of securing mooring bracket 1 to the concrete surrounding the pool. As seen in FIG. 6 the horizontal end 7 is longer than that shown in FIG. 5. A fastener 44 is inserted directly through horizontal end 7 directly into a receptacle in the concrete so that horizontal member 7 is firmly fastened to the concrete. A number of receptacles can be placed around the pool and the detachable immersible support moved to any position where there is a receptacle.

The detachable immersible support may be used to support a seat below the water, a table above the water, an umbrella above the water, or a hoop or other device above or below the water. The length of the up arm 19 will extend above the water when supporting a table. The V-shaped stabilization bracket 4 may be placed closer to the surface of the water when the up leg 19 extends above the water to provide stability to the longer up leg 19. When a submersible seat 45 is placed on article support 3 the V-shaped stabilization bracket 4 is placed low enough on U-shaped frame member 2 so that the V-shaped stabilization bracket 4 serves as a foot rest for the bather.

The detachable immersible support is assembled outside the pool. The fasteners 15 in overlapping pieces 7 and 10 are loosened. In pools with horizontal coping the detachable immersible support may be placed in the pool at any point about the pool and the mooring bracket 1 attached to the coping by sliding overlapping pieces 7 and 10 together to firmly grip the coping and tightening the fasteners 15. When the detachable immersible support is used in association with pools featuring vertical coping the detachable immersible support can be placed at those points about the pool where a receptacle has been drilled or pre-set in the concrete, brick, or wood about the pool.

We claim:

1. A detachable immersible support for supporting articles in a swimming pool comprising a mooring bracket, a U-shaped frame member, an article support, and a frame member spacer, wherein the mooring bracket is comprised of two substantially horizontal oppositely disposed ends of a vertical central portion, one end is adapted to be fastened to the coping on the pool or the ground beside the coping, the vertical portion is adapted to be spaced a short distance inside the wall of the pool, the second horizontal end extends outwardly from the vertical member, the U-shaped frame member is comprised of a down leg, a horizontal leg and an up leg, the upper end of the down leg is fastened to the mooring bracket and is adapted to be suspended substantially parallel to and spaced from the pool wall, the horizontal leg of the U-shaped frame member is arranged at substantially 90 degrees relative to the down leg, the up leg of the U-shaped frame member is arranged at substantially 90 degrees relative to the horizontal leg and substantially parallel to the down leg, the top of the up leg contains a support means to receive and support an article, the frame member spacer is comprised of a member disposed between the lower portion of the down leg of the U-shaped frame member and the pool wall at right angles to the down leg of the U-shaped frame member.

2. A detachable immersible support for supporting articles in a swimming pool comprising a mooring bracket, a U-shaped frame member, an article support, a frame stabiization bracket and a frame member spacer, wherein the mooring bracket is comprised of two substantially horizontal oppositely disposed ends of a vertical central portion, one end is adapted to be fastened to the coping on the pool or the ground beside the coping, the vertical portion is adapted to be spaced a short distance inside the wall of the pool, the second horizontal end extends outwardly from the vertical member, the U-shaped frame member is comprised of a down leg, a horizontal leg and an up leg, the upper end of the down leg is fastened to the mooring bracket and is adapted to be suspended substantially parallel to and spaced from the pool wall, the horizontal leg of the U-shaped frame member is arranged at substantially 90 degrees relative to the down leg, the up leg of the U-shaped frame member is arranged at substantially 90 degrees relative to the horizontal leg and substantially parallel to the down leg, the top of the up leg contains a support means to receive and support an article, the frame stabilization bracket has a general V-shape comprised of two arms extending outwardly from the up leg, the two arms of the frame stabilization bracket being disposed generally parallel to the horizontal leg of the U-shaped frame member, the frame member spacer is comprised of a member disposed between the lower portion of the down leg of the U-shaped frame member and the pool wall at right angles to the down leg of the U-shaped frame member, the outer ends of the two arms of the frame stabilization bracket are fastened to the outer portion of the frame member spacer.

3. The detachable immersible support of claim 1 or 2 in which an upright member is placed in the top of the down leg, an attaching device on the upright member is adapted to receive and retain an article.

4. The detachable immersible support of claim 2 in which an upright member is placed in the top of the down leg, an attaching device on the upright member is adapted to receive and retain an article.

* * * * *